US005251415A

United States Patent [19]

Van Auken et al.

[11] Patent Number: 5,251,415

[45] Date of Patent: Oct. 12, 1993

[54] MESH ROOF FACING SYSTEM

[75] Inventors: Richard H. Van Auken, Prairie Village, Kans.; Lawrence D. Englehart, Largo, Fla.; Ralph C. Hall, Enon, Ohio

[73] Assignee: Butler Manufacturing Company, Grandview, Mo.

[21] Appl. No.: 637,334

[22] Filed: Jan. 3, 1991

[51] Int. Cl.[5] ..... E04B 7/00

[52] U.S. Cl. ..... 52/407; 52/408; 52/406; 52/745.06; 52/741.1

[58] Field of Search ..... 52/454, 676, 63, 407, 52/404, 406, 743, 748, 337, 341, 343, 83, 90, 22, 408, 409, 410, 518, 741.1, 745.05, 745.06

[56] References Cited

U.S. PATENT DOCUMENTS

| | | | |
|---|---|---|---|
| 545,301 | 8/1895 | Milliken . | |
| 619,769 | 2/1899 | Lilienthal | 52/454 |
| 1,682,005 | 8/1928 | De Zonia | 52/63 |
| 2,148,281 | 2/1939 | Scott, Jr. . | |
| 3,388,515 | 6/1968 | Gruehner | 52/748 |
| 3,506,746 | 4/1970 | Fontaine . | |
| 3,791,089 | 2/1974 | Alderman . | |
| 4,047,346 | 9/1977 | Alderman | 52/407 |
| 4,075,807 | 2/1978 | Alderman | 52/90 X |
| 4,434,601 | 3/1984 | Zellmer | 52/407 X |
| 4,522,004 | 6/1985 | Evans et al. . | |
| 4,557,092 | 12/1985 | Brueske . | |
| 5,119,612 | 6/1992 | Taylor et al. | 52/407 X |

*Primary Examiner*—Carl D. Friedman
*Assistant Examiner*—Robert Canfield
*Attorney, Agent, or Firm*—Shoemaker and Mattare, Ltd.

[57] ABSTRACT

A roofing system includes a strong nonmetallic mesh fabric placed loosely over an array of purlins, and secured fast at the periphery of the roof. The fabric, which serves to support roof insulation between the purlins, also has sufficient strength to protect workers laying the insulation, or roofing panels over the insulation, as well as those on the ground below, in case of an accident.

3 Claims, 4 Drawing Sheets

MESH ROOF FACING SYSTEM

BACKGROUND OF THE INVENTION

This invention relates to building construction, and particularly to a mesh roof system for buildings, especially metal buildings with insulated roofs.

Expanded metal, metal screen, and other types of mesh have been proposed previously for use in constructing walls and ceilings of buildings. In some cases, such as in U.S. Pat. No. 4,522,004, cementitious material or plaster is applied over the mesh. Mesh has also been used to support or retain insulating material, an in U.S. Pat. No. 2,148,281.

In U.S. Pat. No. 3,506,746, a net supported by poles serves as a support for receiving plaster of the like, which hardens to form a structure in which door, windows and the like are subsequently cut. U.S. Pat. No. 545,301 describes a method of constructing an arched roof by applying concrete or cement to a corrugated wire mesh supported by structural beams.

U.S. Pat. No. 4,557,092 describes an insulating blanket having a strong scrim layer attached to its fiber barrier, to resist falling objects. It has been found difficult, however, to create joints of sufficient strength in such material to prevent heavy objects from falling through.

Finally, flexible materials have been used to support ceiling insulation in a dropped ceiling construction, as shown in U.S. Pat. No. 3,791,089.

None of the above patents adequately addresses the problem of worker safety; nor does the known prior art provide a simple, durable and attractive way of retaining glass fiber blanket insulation on the roof of a metal building. We re-address safety and structural considerations with this invention, and simultaneously provide aesthetic and functional advantages over prior roof insulation retention methods.

We are particularly concerned with construction worker safety. Unfortunately, injuries occur from time to time during roof construction, either to workmen who fall from the roof, or those below, from dropped objects. It is therefore standard and required practice to provide safety netting or other sheet material below roof installers to protect them and those below, and/or to require workers to be tied or tethered to the structure.

Dropped tools are a another problem; the safety netting designed to catch falling workmen is generally of a sufficiently large mesh (e.g., six inch mesh) to allow small tools, bolts, fasteners, and other construction materials to pass through. Conventional practice is to deploy a separate, smaller mesh debris net below the safety netting, to catch such articles.

Furthermore, required safety practices are sometimes violated. For example, if a required tether is not applied, or while it is being moved, the workman and those below him are at risk. It would be better to have a restraint that could not be avoided, and did not require a positive action to be effective. That is, a restraint analogous to an automobile air bag is preferred over one analogous to a seat belt, since the former cannot be avoided.

We have found that a very simple, attractive and durable insulated roof can be constructed with a strong mesh fabric that reduces the likelihood and severity of construction accidents resulting from falling objects, and also forms a permanent part of the roof.

SUMMARY OF THE INVENTION

An object of the invention is to provide an improved mesh roof facing system comprising a plurality of transverse beams, an array of spaced, parallel purlins each extending orthogonal to the beams, and a plurality of roof panels laid across and supported by the purlins. The improvement comprises a nonmetallic mesh extending over and supported by a plurality of the purlins, beneath the roof panels. Insulating material is preferably included as well, supported from below by the mesh, between the mesh and the roof panels. The purlins may be Z-channel metal members, bar joists, trusses (see FIG. 6), or wooden joists.

It is particularly preferred that the mesh be strong enough, when secured over the purlins, to support a substantial weight dropped upon it between purlins, and that the mesh be applied loosely, so that it sags substantially between the purlins, to improved its loading capability and to provide room under the roofing panels for a substantial thickness of insulation.

BRIEF DESCRIPTION OF THE DRAWINGS

In the accompanying drawings.

DESCRIPTION OF THE PREFERRED EMBODIMENT

Figure 1:
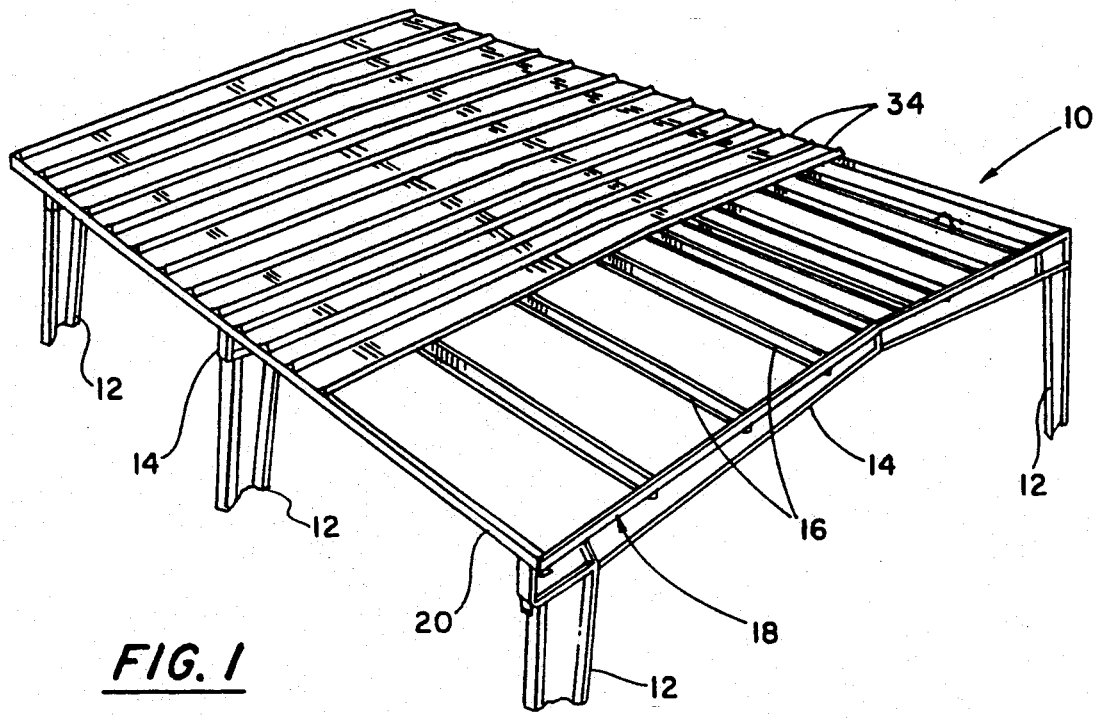
FIG. 1 is an isometric view of a roof embodying the invention.
Figure 2:
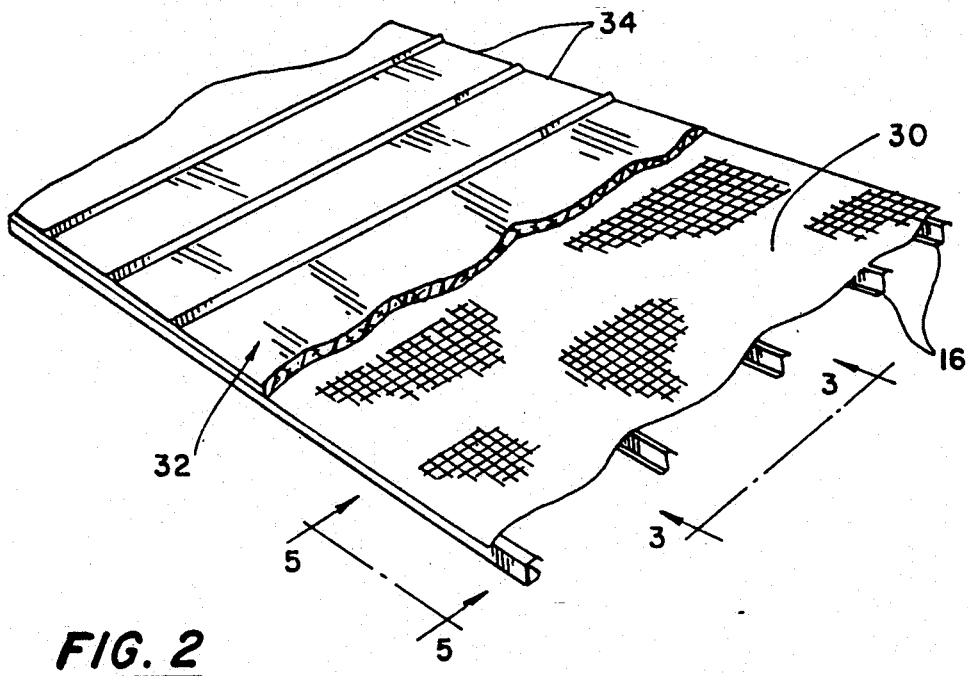
FIG. 2 is an isometric view, in partial section, showing a portion of FIG. 1 at a greater scale.
Figure 3:
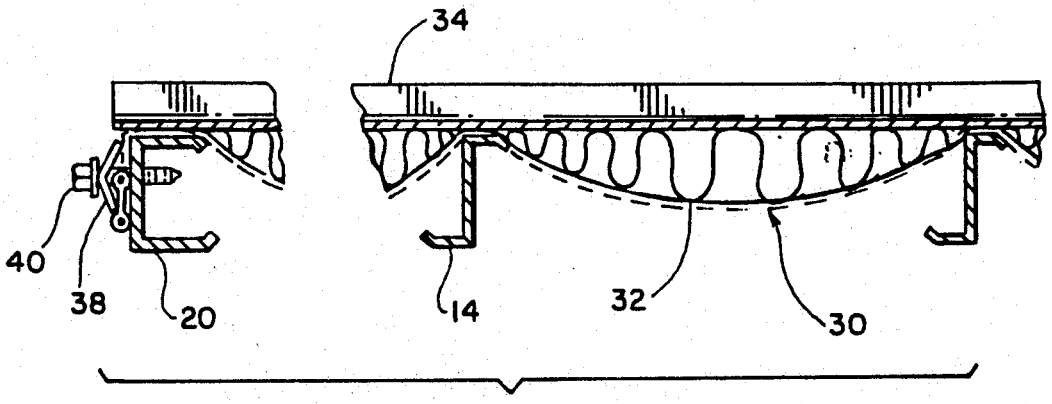
FIG. 3 is a sectional view taken along the line 3—3 in FIG. 2.

As shown in FIGS. 1 and 2, a building embodying the invention has a frame 10 composed of plural pairs of vertical structural members 12, each pair of members being interconnected at their upper ends by a transverse structural beam 14. The transverse beams support an array of parallel purlins 16, each extending orthogonal to the transverse beams along the length of the building. The purlins are equally spaced, for example at five foot intervals. As shown in FIG. 3, the purlins may be Z-section members formed from sheet metal. Their exposed ends at either end of the building are capped by gable angles 18. Eave struts 20 are provided at the edges of the roof, each extending parallel to the purlins; the eaves are preferably C section members whose open sides face toward the center of the roof.

FIGS. 2 and 3 show a mesh material 30 laid loosely across the roof, directly over the purlins. By "loosely", we mean that, when loaded with insulation, the fabric forms throughs having a depth of about six inches to one foot, depending on the thickness of the insulation, below the level of the purlins. The mesh supports a blanket of insulation 32, preferably glass fiber batting. Finally, metal roof panels 34 are laid over the insulation, transverse to the length of the purlins.

Figure 4:
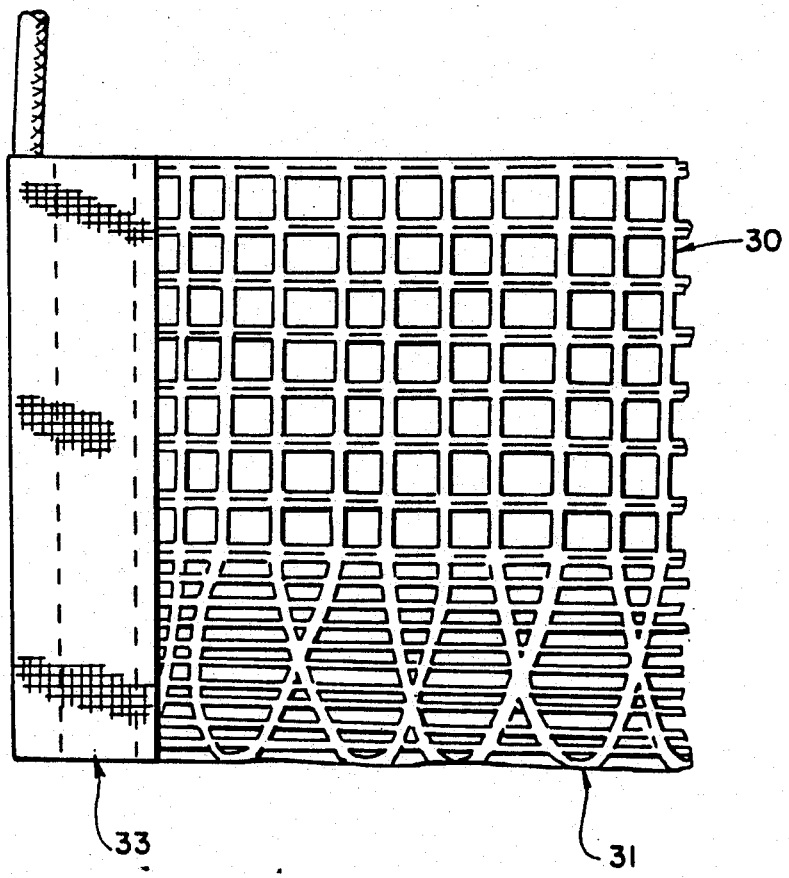
FIG. 4 is a plan view of a portion of a mesh material used with this invention, at a greatly enlarged scale.

The preferred mesh material is an open polyester scrim mesh interwoven to form a half-inch square grid, coated with a fire retardant polyvinyl chloride binder. The mesh should be of sufficient strength to withstand the weight of a 200–300 pound man from a height of three feet above the plane of the purlins. A mesh material weighing 2.6 ounces per square yard, and meeting the strength requirements of the preceding sentence, is available from Bay Mills Limited, Ontario, Canada, in rolls seven to ten feet wide; it is identified by Bay Mills as "Bayex Product QX-2220/V". For standard buildings bays, thirty feet wide (the distance between beams), several widths of the material are spliced together edgewise with plastic tie straps, stitching, or other fasteners chosen to provide an edge-to-edge fastening strength as great as that of the material itself, to prevent joint failure. The edges of the material, as received from the manufacturer, are reinforced by a selvedge 31 (FIG. 4). The free end of the material is reinforced by a beaded fabric tape 33 sewn over the end, and newly exposed raw ends may be similarly reinforced in the field, optionally with reinforcing rope at the selvedge if desired.

Figure 5:
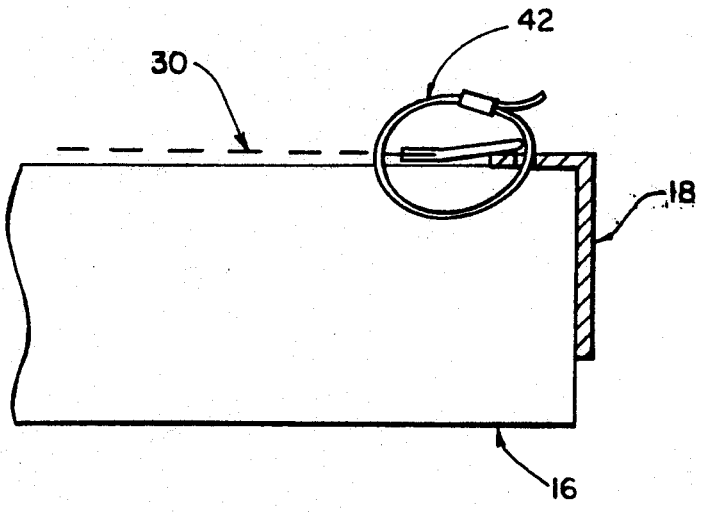
FIG. 5 is a detailed sectional view taken along the line 5—5 in FIG. 2, showing a nylon tie arrangement for securing the mesh.

The mesh is sandwiched at its leading and trailing edges between a respective one of the eave struts and a steel strap 38 having a slight dihedral angle, as shown in FIG. 3. The strap is drawn against the structural member by self-drilling or self-tapping screws 40 applied at one-foot intervals. The lateral edges of the material strip may be secured to the gable angle in the same manner, or by plastic ties 42 (FIG. 5) extending through holes in the angle 18 at intervals.

Figure 6:
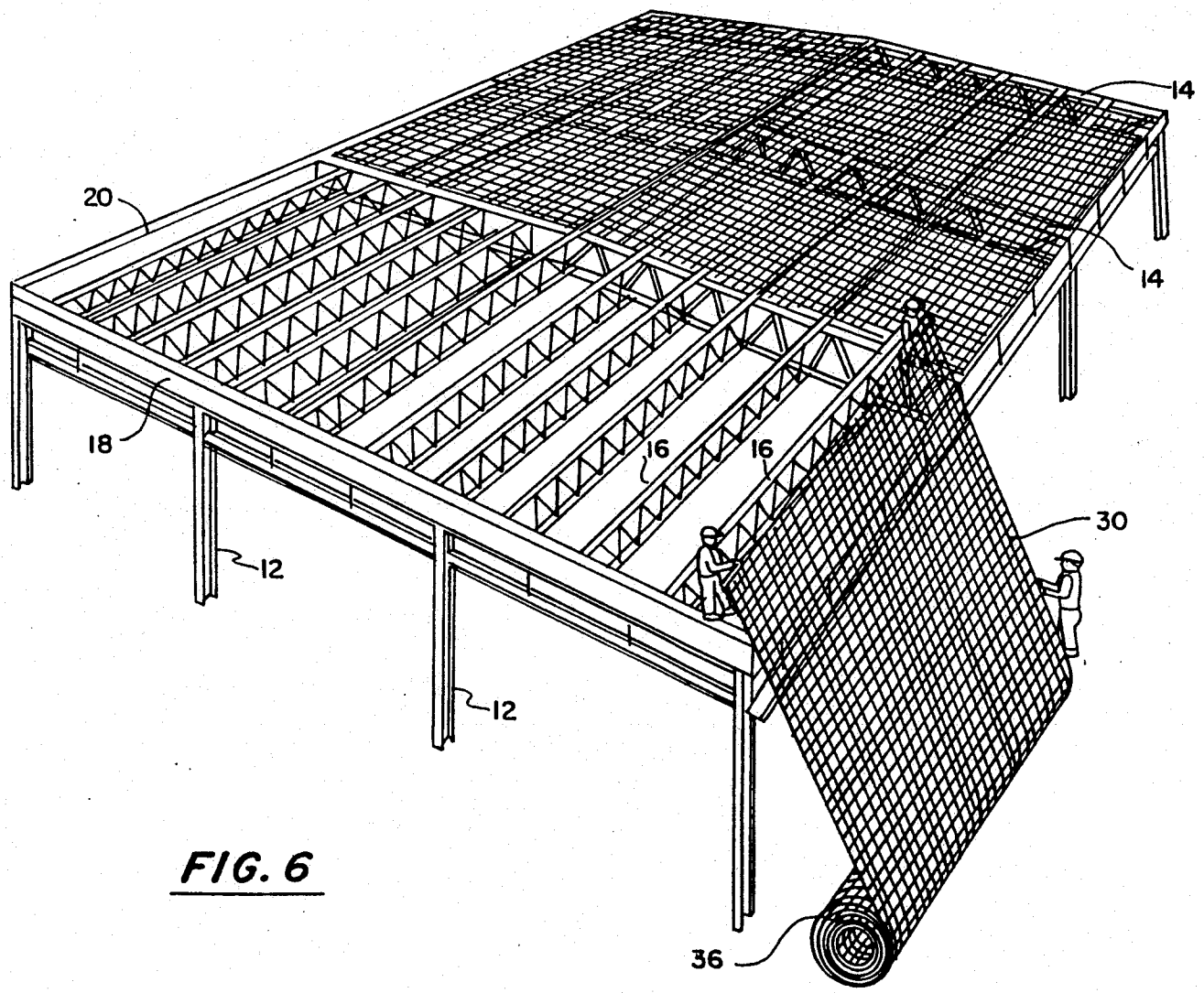
FIG. 6 is an isometric view showing mesh material being installed on a roof frame.

In use, a thirty-foot wide roll 36 of mesh material, previously spliced from narrower rolls of material, if necessary, is positioned to one side of the building, with its axis parallel to the purlins, as shown in FIG. 6. The leading edge of the material is then pulled up, over the respective eave strut, and across the purlins. The mesh is maintained relatively taut transverse to its width (i.e., along the length of the purlins), but is installed loosely along its own length, to form six-inch to one-foot troughs as mentioned above. The leading edge of the material is secured to the far eave strut by straps and screws as described previously. The lateral edges of the material are similarly affixed to the gable angle or transverse beam beneath, and the trailing edge is affixed to the near eave strut. The remaining roll material is severed, and the roll is moved a distance equal its width along the building, where the covering process is repeated. Once the entire roof has been covered with mesh, insulation is laid on the mesh and both are then covered with the metal roof panels. During these latter operations, the secured, strong mesh provides significant safety to workers on and below the roof.

The added worker safety is obtained at minimal cost, since the same fabric that provides protection during construction also supports the insulation, and becomes a permanent part of the building. Since it remains in position for the life of the roof, it may serve to protect people from falling through skylights or other openings in the roof; furthermore, it protects the insulation layer from tears. Additionally, we have found that the mesh is virtually invisible against the background of glass fiber blanket insulation, and thus provides an innocuous support for the insulation, resulting in an attractive interior surface.

While particular advantages result when the mesh is used to retain blanket insulation, the safety advantages are provided even with a rigid board insulation, such as "Thermax" (trademark of Celotex Corporation) or Butler Manufacturing's "CMR-24" insulation, or plywood, or even when no insulation at all is installed over the mesh.

The invention of course does not protect workers from falling off the edge of the building, and is not represented to replace currently OSHA-approved devices and procedures for protecting personnel from falls, even at the center of the building, although it doubtless will improve safety.

The foregoing description illustrates only one mode—the best now contemplated—of practicing the invention. Many changes can be made to details without departing from the gist of the invention claimed below. For example, the metal roof covering panels could be replaced by plastic, wood, or other panels; for this reason, we refer to the panels only as "weatherproof" in the claims. Also, insulating materials other than glass fiber blanket may prove useful. And the members referred to above as "purlins" could be any functionally equivalent members, including wooden joists, or truss-type members such as Butler Manufacturing's "Delta Joist". "Purlins" in the following claims is intended to cover all such variations.

Figure 7:
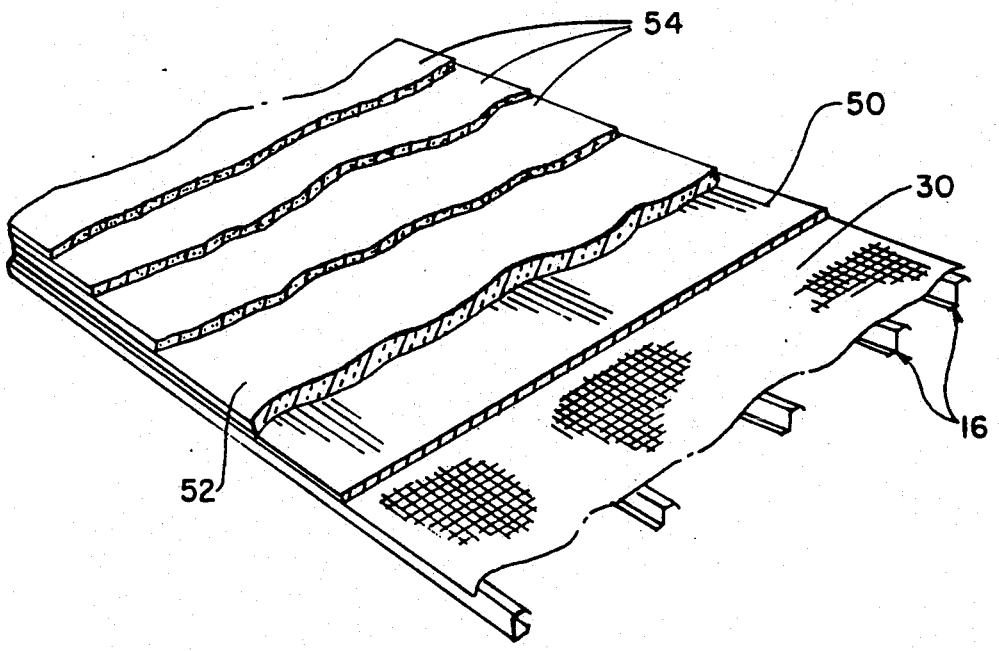
FIG. 7 is a view like FIG. 2, showing a modified form of the invention.

Another contemplated variation of the invention (see FIG. 7) is to provide a steel deck 50, supported by the purlins 16 on which the mesh 30 has previously been laid. The decking may subsequently be covered by rigid insulating board 52, and then topped with a weatherproof coating of felts 54 and bitumen.

Inasmuch as the invention is subject to these and other modifications and variations, it is intended that the foregoing description and the accompanying drawings shall be interpreted as illustrative of only one form of the invention, whose scope is to be measured by the following claims.

I claim:

1. In a roof construction including a plurality of transverse beams, a plurality of spaced, parallel purlins each extending orthogonal to the beams, and a plurality of roof panels laid across and supported by the purlins, the improvement comprising at least one length of a nonmetallic mesh extending over and supported by said purlins, beneath said panels, said mesh having a width of at least thirty feet and no seam weaker than the material itself, and an insulating layer supported from below by said mesh, between the mesh and the roof panels, wherein said non-metallic mesh sags at least six inches between adjacent purlins, to avoid undue compression of the insulating material.

2. A roof construction including a plurality of transverse beams, a plurality of spaced, parallel purlins each extending orthogonal to the beams, a nonmetallic mesh extending over and supported by said purlins, a steel roof deck laid over said mesh and supported by the purlins, a layer of board insulation laid on top of said deck, and a built-up roof surface constructed of felts and bitumen on top of said board insulation.

3. A method of constructing an insulated roof safety, comprising the steps of erecting a supporting roof substructure including an array of purlins, covering said purlins loosely with a strong nonmetallic mesh material by drawing said mesh from a roll thereof at ground level onto and a cross the roof, securing the leading edge of the mesh to one eave of the roof, and the trailing edge thereof to the other eave, with sufficient slack to produce a sag of at least six inches between purlins, securing said material at its perimeter to said substructure, covering said material with a layer of insulating material, and covering said insulating material with weatherproof panels.

* * * * *